US011784391B2

(12) United States Patent
Kong et al.

(10) Patent No.: US 11,784,391 B2
(45) Date of Patent: Oct. 10, 2023

(54) HEATING WIRE STRUCTURE FOR GLASS

(71) Applicants: HYUNDAI MOTOR COMPANY, Seoul (KR); KIA MOTORS CORPORATION, Seoul (KR); KCC GLASS CORPORATION, Seoul (KR)

(72) Inventors: Nak Kyoung Kong, Seongnam-si (KR); Jong Min Park, Hwaseong-si (KR); Kang Sun Lee, Seongnam-si (KR); Ki Hong Lee, Seoul (KR); Chan Joo Moon, Hwaseong-si (KR); Seung Hyeok Chang, Suwon-si (KR); Kuk Bum Lee, Sejong-si (KR); Eun Ho Lee, Sejong-si (KR); Chan Hee Lee, Sejong-si (KR)

(73) Assignees: HYUNDAI MOTOR COMPANY, Seoul (KR); KIA MOTORS CORPORATION, Seoul (KR); KCC GLASS CORPORATION, Seoul (KR)

( * ) Notice: Subject to any disclaimer, the term of this patent is extended or adjusted under 35 U.S.C. 154(b) by 707 days.

(21) Appl. No.: 16/579,963

(22) Filed: Sep. 24, 2019

(65) Prior Publication Data

US 2020/0313276 A1 Oct. 1, 2020

(30) Foreign Application Priority Data

Mar. 26, 2019 (KR) ..... 10-2019-0034003

(51) Int. Cl.
*H01Q 1/12* (2006.01)
*H05B 3/44* (2006.01)

(52) U.S. Cl.
CPC ..... *H01Q 1/1278* (2013.01); *H05B 3/44* (2013.01)

(58) Field of Classification Search
CPC ..... B60H 1/2218; B60H 1/00742; B60H 1/00792; B60H 1/00971; B60H 1/2225;
(Continued)

(56) References Cited

U.S. PATENT DOCUMENTS 9,596,719 B2 3/2017 Offermann et al.
2009/0128431 A1* 5/2009 Martin ..... B32B 17/10376 343/713
(Continued)

FOREIGN PATENT DOCUMENTS

JP H0640252 A 2/1994
JP 2002204116 A 7/2002
JP 2016167663 A * 9/2016 ..... H01Q 1/1278
KR 200434258 Y1 2/2006
KR 10-2006-0089814 8/2006
(Continued)

*Primary Examiner* — Shawntina T Fuqua
(74) *Attorney, Agent, or Firm* — LEMPIA SUMMERFIELD KATZ LLC

(57) ABSTRACT

The heating wire structure for glass includes a sheet of glass in a vehicle having a battery located within the vehicle and configured to apply power to heating wires located on the glass according to a user request, the heating wires located in one direction on the glass and connected to terminals of the battery in series, vertical bars located at both ends of the glass so that the heating wires are connected to the vertical bars, antenna lines connected to the antenna, at least some of the antenna lines including intersection points formed by intersecting the heating wires, and a ceramic layer formed at intersecting areas between the heating wire lines and the antenna lines to be located between the heating wire lines and the antenna lines.

7 Claims, 3 Drawing Sheets

(58) Field of Classification Search
CPC ..... B60H 1/2215; B60H 2001/2293; H05B 1/0236; H05B 1/0294; H05B 3/34; H05B 3/84; H05B 3/22; H05B 3/845; H05B 3/86; H05B 3/42; H05B 3/46; H05B 3/48; H05B 3/44; H05B 3/0019; H05B 3/02; H05B 3/03; H05B 3/06; H05B 3/342; H05B 3/347; H05B 3/345; H05B 3/0047; H05B 3/008; H05B 2203/002; H05B 2203/013; H05B 2203/008; H05B 2203/011; H05B 2203/02; H05B 2203/031; H05B 2203/014; H05B 2214/02; H01Q 1/1278; H01Q 1/325; B60S 1/026; B60J 1/002; B60J 1/06
See application file for complete search history.

(56) References Cited

U.S. PATENT DOCUMENTS

| | | | | |
|---|---|---|---|---|
| 2011/0233182 | A1* | 9/2011 | Baranski ..... | H05B 3/86 219/203 |
| 2013/0092676 | A1 | 4/2013 | Offermann et al. | |
| 2015/0230292 | A1* | 8/2015 | Minamiya ..... | H05B 3/86 219/203 |
| 2018/0123219 | A1* | 5/2018 | Doi ..... | B60K 6/22 |

FOREIGN PATENT DOCUMENTS

| | | | | |
|---|---|---|---|---|
| KR | 20130066656 | A | | 6/2013 |
| TW | 508865 | B | * | 11/2002 |

* cited by examiner

HEATING WIRE STRUCTURE FOR GLASS

CROSS-REFERENCE TO RELATED APPLICATION

This application claims priority to and the benefit of Korean Patent Application No. 10-2019-0034003, filed on Mar. 26, 2019, which is incorporated herein by reference in its entirety.

FIELD

The present disclosure relates to a heating wire structure for glass. More particularly, it relates to the heating wire structure for a window glass in a vehicle.

BACKGROUND

The statements in this section merely provide background information related to the present disclosure and may not constitute prior art.

In a wet and/or humid condition, a vehicle window glass may be steamed up or blur, and thus a driver has a difficulty in seeing objects at the outside of a vehicle. In a cold weather condition, the vehicle window glass may be frost, and thus the driver may suffer poor visibility.

It is well known that a heating circuit is provided on a rear window glass, a front window glass or a side window glass of a vehicle so as to overcome poor visibility. Heating wires used therein are configured in any one of three types, i.e., a first type in which an array of heating wires printed with an electrically conductive ink is provided to an inner surface of a window glass, a second type in which electrically conductive coating is performed across one of a plurality of layers forming a glass stack, and a third type in which an array of heating wires embedded in an interlayer material to bond glass layers forming a glass stack together is provided. Therefore, various designs of heating wires and heating wire arrays, and various types of coating are known and thus various vehicle window glass designs are developed.

Window glasses provided with three types of heating wires above require connection to a 12V battery of a vehicle which is installed to allow current to pass through a heating circuit or coating. The battery is configured to apply current to each heating wire or conductive coating, and electrical connection is performed by vertical bars, i.e., areas of an electrically conductive material, molded with tin-copper strips and connected to an external wiring system.

Furthermore, recently, a heating wire structure including antenna lines inserted into an inner surface of a rear window glass has been introduced, and such a heating wire structure is configured to be interconnected with various AVN (Audio, Video, and Navigation) systems which may be supported by vehicles.

However, we have discovered that in order to execute application of a 42V~48V battery, the conventional heating wire structure including vertical bars connected in parallel may cause overheating of the heating wire lines.

In addition, we have discovered that at a connection position between an antenna line and the heating wire line, current transmitted from the battery may be applied to the antenna line. Document KR Patent Application No. 10-2005-0010579 relates to a glass antenna for a vehicle.

The above information disclosed in this Background section is only for enhancement of understanding of the background of the present disclosure, and therefore it may contain information that does not form the prior art that is already known to a person of ordinary skill in the art.

SUMMARY

The present disclosure provides a heating wire structure for glass which inhibits heating or short circuit of antenna lines caused by application of current along the antenna lines, if a 42V~48V battery system is introduced.

Furthermore, the present disclosure provides a heating wire structure for glass in which antenna lines and heating wire lines are stacked so that a stable amount of electricity is applied to the heating wires lines connected in series.

According to a form of the present disclosure, a heating wire structure for glass includes a sheet of glass in a vehicle having a battery located within the vehicle and configured to apply power to heating wires located on the glass according to a user request, the heating wires located in one direction on the glass and connected to terminals of the battery in series, vertical bars located at both ends of the glass so that the heating wires are connected to the vertical bars, antenna lines connected to the antenna, at least some of the antenna lines including intersection points formed by intersecting or crossing over the heating wires, and a ceramic layer formed at intersecting positions (or areas) between the heating wire lines and the antenna lines and located between the heating wire lines and the antenna lines.

According to a further aspect of the present disclosure, the ceramic layer may be formed of a material having the same properties as an enamel part.

According to a further aspect of the present disclosure, the ceramic layer may extend along at least one of the antenna lines or the heating wire lines by a predetermined range.

According to a further aspect of the present disclosure, the battery may provide a voltage of 42V-48V.

According to a further aspect of the present disclosure, the heating wires may include a plurality of heating wire lines disposed in a horizontal direction of the glass.

According to a further aspect of the present disclosure, the at least some of the antenna lines may be disposed in a vertical direction of the glass.

According to a further aspect of the present disclosure, the terminals connected to a cathode and an anode of the battery may be located at upper and lower ends of one side part of the glass, respectively.

According to a further aspect of the present disclosure, the heating wire structure for glass may further include an enamel part configured to surround an edge of the glass.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
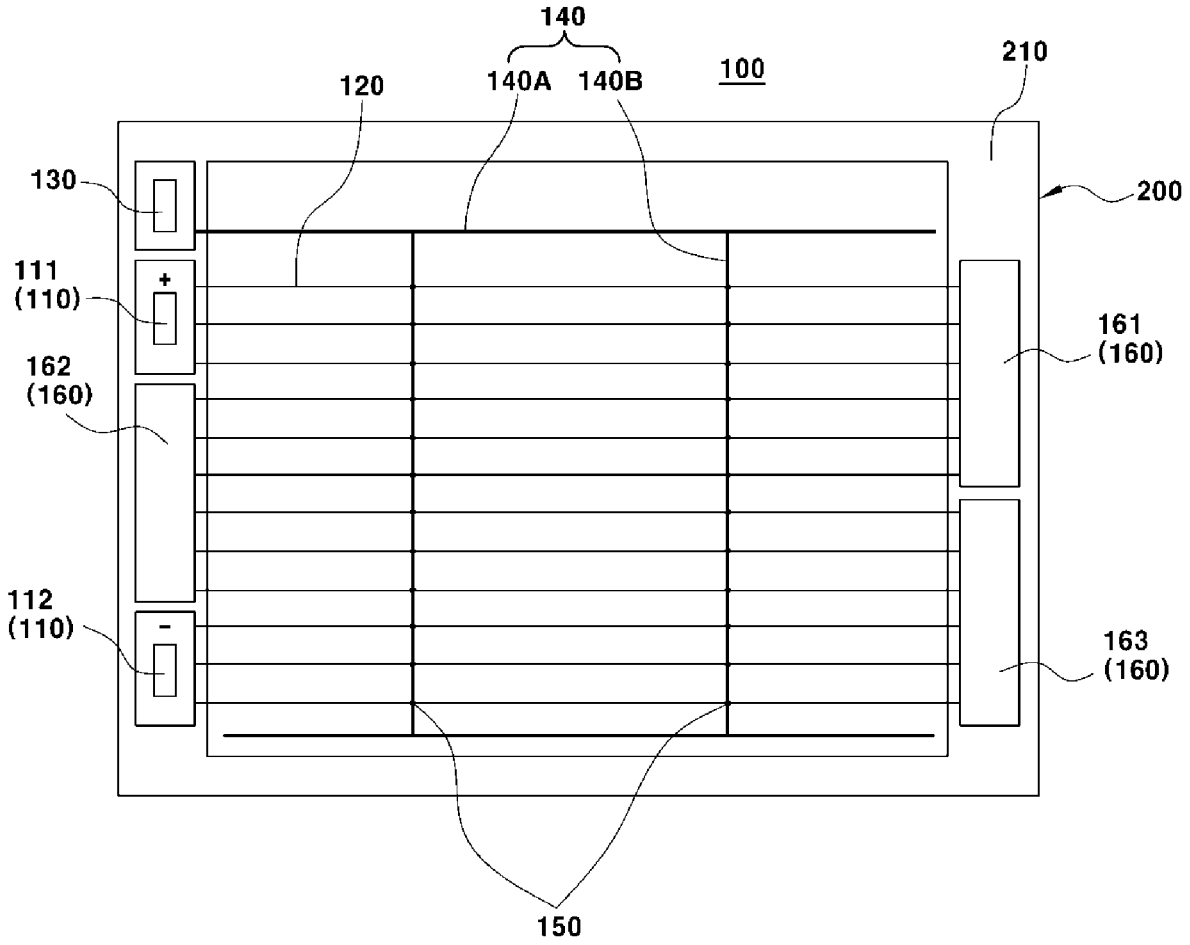
FIG. 1 is a schematic view illustrating the configuration of a rear window glass including a heating wire structure for glass in accordance with one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following description, it will be understood that terms, such as " . . . part", " . . . unit", " . . . module", " . . . layer" etc., mean units to process at least one function or operation, and they may be implemented by hardware or a combination of hardware.

In addition, in the following description, it will be understood that terms, such as first, second, third, etc., are used only to distinguish one element from other elements and do not limit their sequence.

Further, in the following description, the terms "heating wire" and "heating wire line" may be used to refer to the same element.

FIG. 1 illustrates a heating wire structure for glass 100, such as a sheet of glass operating as a window in accordance with one form of the present disclosure, which is located on a rear window glass 200.

As exemplarily shown in this figure, a sheet of glass forming the rear window glass 200 located at a rear portion of a vehicle includes an enamel part 210 configured to surround the entirety of the edge of the rear window glass 200. The edge of the rear window glass 200 at which the enamel part 210 is located may be configured such that at least a part of the edge of the rear window glass 200 may be inserted into an outside panel of the vehicle, thus inhibiting vertical bars 160, terminals 110, an antenna 130, etc., which are located at the enamel part 210, from being exposed to the outside.

The terminals 110 configured to be coupled to a cathode 111 and an anode 112 of a battery are located at a side end of the rear window glass 200, and more particularly, the terminal 110 coupled to the cathode 111 of the battery may be located at the top of a side end of the rear window glass 200 and the terminal 110 coupled to the anode 112 of the battery may be located at the bottom of the same side end of the rear window glass 200 as the terminal 110 coupled to the cathode 111.

The terminals 110 may be coupled to heating wire lines 120 adjacent to the lower ends thereof through soldering 113, and be configured so that voltage from the terminal is applied to the terminals 110.

The heating wire lines 120 are configured so as to be disposed in one direction of the rear window glass 200 starting from one terminal 110. In one form of the present disclosure, the heating wire lines 120 starting from the left side end of the rear window glass 200, where the terminal 110 is connected to the cathode 111 of the battery, extend to a first vertical bar 161 located at the right side end of the rear window glass 200, extend from the first vertical bar 161 to a second vertical bar 162, extend from the second vertical bar 162 to a third vertical bar 163, and then extend from the third vertical bar 163 to the bottom of the left side end of the rear window glass 200, where the terminal 110 is connected to the anode 112 of the battery.

In the present disclosure, the heating wire lines 120 extending to the vertical bars 160 are configured to be continuously connected to the respective vertical bars 160 in series, and thus the heating wire lines 120 are connected from the terminal 110 connected to the cathode 111 to the terminal connected to the anode 112 in series.

More particularly, as the heating wire lines 120 in accordance with the present disclosure, at least two heating wire lines 120 (for example, three or four heating wire lines) may be configured to be located in the horizontal direction of the rear window glass 200 and extend to the vertical bars 160. However, the number of the respective heating wire lines 120 connected in series through the vertical bars 160 is not limited.

The antenna 130 may be located at one side region of the upper end of the enamel part 210, and be configured not to be exposed to the outside through a rear spoiler, or the like. More particularly, the antenna 130 may be located at a position facing the rear spoiler, and thus be configured to reduce exposure thereof to the outside.

Both horizontal antenna lines 140A and vertical antenna lines 140B which are connected to the antenna 130 are provided, and more particularly, the horizontal antenna lines 140A may be disposed to be substantially parallel to the heating wire lines 120 and the vertical antenna lines 140B may be disposed to be perpendicular to the heating wire lines 120.

Intersection points 150 where the heating wire lines 120 and the antenna lines 140 intersect each other are formed such that the heating wire lines 120 crosses the antenna lines 140. In particular, the respective intersection points 150 may be located between the heating wire lines 120 located in the horizontal direction on the rear window glass 200 and the vertical antenna lines 140B located in the vertical direction on the rear window glass 200.

In one form of the present disclosure, a ceramic layer 170 located between the heating wire line 120 and the antenna line 140 is provided at the intersection points 150 between the heating wire lines 120 and the antenna lines 140, and thus, if current is applied along the heating wire lines 120, the current applied to the heating wire lines 120 is not applied to the antenna lines 140.

The ceramic layer 170 may be configured to be located between the heating wire line 120 and the antenna line 140, and the heating wire line 120, the ceramic layer 170 and the antenna line 140 may be sequentially stacked on the rear window glass 200 at the intersection point 150, or, in accordance with another form, the antenna line 140, the ceramic layer 170 and the heating wire line 120 may be sequentially stacked on the rear window glass 200 at the intersection point 150.

In summary, the ceramic layer 170 is located between the heating wire line 120 and the antenna line 140, and the stacking sequence of the heating wire line 120, the ceramic layer 170 and the antenna line 140 may be changed according to mass production environments.

Furthermore, in accordance with one form of the present disclosure, the heating wire structure for glass 100 located on the rear window glass 200 is provided through printing processes, and the antenna lines 140 including the antenna 130 are primarily printed on the rear window glass 200. Then, a process of printing a black enamel layer at the edge or the rear window glass 200 and predicted points as the intersection points 150 is performed.

Thereafter, a printing screen including the vertical bars 160 and the heating wire lines 120 is printed on the rear window glass 200 provided with the black enamel layer printed thereon, and thus the rear window glass 200 including the heating wire structure for glass 100 is manufactured.

As such, the heating wire structure for glass 100 in accordance with one form of the present disclosure may be manufactured through three printing processes performed on the rear window glass 200, and thus desire three printing screens corresponding to these processes.

In accordance with another form of the present disclosure, a process of printing a black enamel layer at the edge of a rear window glass 200 of vehicle is performed, and then a process of printing vertical bars 160 and heating wire lines 120 on the rear window glass 200 provided with the black enamel layer printed at the edge thereof is performed.

Thereafter, a process of printing a ceramic layer (black enamel layer) 170 at predicted points as intersection points 150 where the heating wire lines 120 and antenna lines 140 intersect each other and a process of printing the antenna lines 140 on the ceramic layer 170 are sequentially performed, and thereby a heating wire structure for glass 100 is manufactured.

The heating wire structure for glass 100 in accordance with another form of the present disclosure may be manufactured through fixing of four printing screens at the upper end of the window glass 200.

More particularly, the enamel part 210 and the ceramic layer 170 of the present disclosure may be printed using the same material, and thus the enamel part 210 and the ceramic layer 170 may be printed through one screen.

Figure 2:
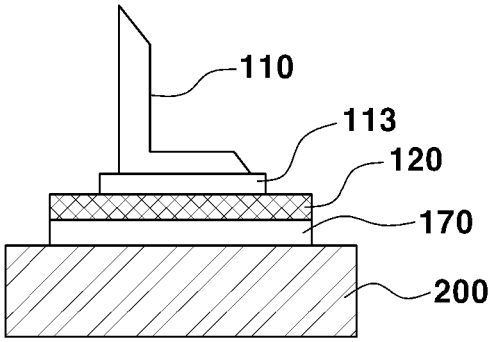
FIG. 2 is a cross-sectional view of the rear window glass coupled to a battery terminal in accordance with one form of the present disclosure.

FIG. 2 is a cross-sectional view of the rear window glass 200 provided with the terminal 110 located thereon, in accordance with one form of the present disclosure.

According to a form of the present disclosure, the heating wire structure for glass 100 includes a battery which applies voltage of 42V-48V, and current is applied to the heating wire lines 120 from the battery through the terminals 110.

As exemplarily shown in FIG. 2, the terminal 110 connected to the battery is located at one side end of the upper surface of the rear window glass 200, and the terminal 110 is configured to be coupled to the heating wire lines 120. The terminal 110 and the heating wire lines 120 are coupled through soldering 113.

The terminal 110 is configured to be connected to the heating wire lines 120 in series, and thus current applied to the heating wire lines 120 may be determined by dividing applied voltage of 42V-48V by a resistance value between the heating wire lines 120.

More particularly, the enamel part 210 (see FIG. 1) may be provided on the rear window glass 200 and inhibit current introduced through the terminal 110 from directly flowing into the vertical bars 160 or the like located at the side ends of the rear window glass 200 without flowing along the heating wire lines 120, through the ceramic layer 170 located between the heating wire lines 120 and the rear window glass 200.

Figure 3:
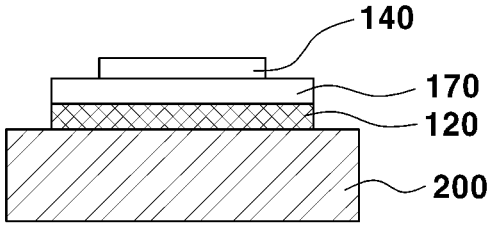
FIG. 3 is a cross-sectional view of the rear window glass at an intersection point between a heating wire line and an antenna line in accordance with one form of the present disclosure.

FIG. 3 is a cross-sectional view of the heating wire structure for glass 100 at the intersection point 150, in accordance with one form of the present disclosure.

In one form of the present disclosure, the heating wire lines 120 are configured to be located in parallel in a designated direction on the rear window glass 200, and the antenna lines 140 include the horizontal antenna lines 140A disposed in substantially the same direction as the heating wire lines 120 and the vertical antenna lines 140B disposed in a direction perpendicular to the heating wire lines 120.

The heating wire lines 120 and the vertical antenna lines 140B disposed to be perpendicular to the heating wire lines 120 intersect each other, thus forming the intersection points 150. The ceramic layer 170 located between the heating wire line 120 and the antenna line 140 is disposed at the intersection points 150, and thus current flowing along the heating wire lines 120 is not applied to the antenna lines 140.

More particularly, the ceramic layer 170 may be configured to have the same properties as the enamel part 210 surrounding the entirety of the edge of the rear window glass 200, reduce exposure thereof to the outside, and include any component which may perform electrical insulation.

Table 1 below states results representing evaluation values of examples 1 and 2 of the present disclosure and comparative examples 1 and 2.

Comparative examples 1 and 2 provide conventional heating wire structures for glass which include heating wire lines connected in parallel using a 12V battery, and values of resistance, voltage, current, an amount of electricity and a maximum temperature of the heating wire structures for glass were measured.

Conducting wires used as the heating wire lines according to comparative examples 1 and 2 were manufactured to have a size of 3.0 sq(mm2).

Examples 1 and 2 provide heating wire structures for glass 100 in accordance with the present disclosure which include heating wire lines 120 connected in series using a 42V~48V battery, antenna lines 140 and a ceramic layer 170 provided at intersection points 150 between the heating wire lines 120 and the antenna lines 140, and values of resistance, voltage, current, an amount of electricity and a maximum temperature of the heating wire structures for glass 100 were measured.

Further, conducting wires used as the heating wire lines 120 of the heating wire structures for glass 100 according to examples 1 and 2 of the present disclosure were manufactured to have a size of 1.0 sq(mm2).

In comparative examples 1 and 2 and examples 1 and 2, both horizontal antenna lines 140A and vertical antenna lines 140B are provided.

Table 1 below states evaluation data acquired from two types of vehicles.

TABLE 1

| Vehicle type | A | | B | |
|---|---|---|---|---|
| Evaluation | Heating simulation | | | |
| Printing condition | Comparative example 1 (in parallel-15 lines) | Example 1 (4 columns-4 lines, 4 lines, 4 lines, 4 lines) | Comparative example 2 (in parallel-13 lines) | Example 2 (4 columns-3 lines, 3 lines, 3 lines, 4 lines) |
| Actually measured resistance value (Ω) | 0.606 | 9.585 | 0.7 | 10.4 [15.92 times] |
| Applied voltage (V) | 12 | 48 | 12 | 48 |
| Current (A) | 19.8 | 5.0 | 18.3 | 4.6 |
| Electric power (W) | 237.6 | 240.4 | 220 | 220 |
| Maximum temp. (° C.) | 53.5 | 55.4 | 43.8 | 43.8 |

As stated above, resistance, voltage, current, an amount of electricity and a maximum temperature of 15 heating wire lines having a cross-sectional area of 3.0 sq(mm2) and connected in parallel according to comparative example 1 were measured, and resistance, voltage, current, an amount of electricity and a maximum temperature of 13 heating wire lines having a cross-sectional area of 3.0 sq(mm2) and connected in parallel according to comparative example 2 were measured.

In comparison, resistance, voltage, current, an amount of electricity and a maximum temperature of 16 heating wire lines 120 having a cross-sectional area of 1.0 sq(mm2) and connected in series, to which voltage of a 42V~48V battery is applied, according to example 1, applied to the same vehicle as in comparative example 1, were measured, and resistance, voltage, current, an amount of electricity and a maximum temperature of 13 heating wire lines 120 having a cross-sectional area of 1.0 sq(mm2) and connected in series, to which voltage of a 42V~48V battery is applied, according to example 2, applied to the same vehicle as in comparative example 2, were measured.

Further, the heating wire structures for glass 100 according to examples 1 and 2 include the ceramic layer 170 between the antenna line 140 and the heating wire line 120, and is thus configured such that current is not applied to the antenna lines 140.

As described in the above measurement results, actually measured resistance values of the heating wire lines 120 connected in series in the heating wire structures for glass 100 according to examples 1 and 2 were 15 times or more those of the heating wire lines connected in parallel in the heating wire structures for glass according to comparative examples 1 and 2. Further, voltage of 42V-48V from the battery was applied to the heating wire lines 120 according to examples 1 and 2.

Amounts of electricity used in the heating wire lines 120 according to examples 1 and 2 were actually similar to amounts of electricity used in the heating wire lines according to comparative examples 1 and 2, and this is caused by the increased resistance values of the heating wire lines 120 according to examples 1 and 2.

Further, maximum temperatures provided by the heating wire lines 120 according to examples 1 and 2 were actually similar to maximum temperatures provided by the heating wire lines according to comparative examples 1 and 2, and this means that performance of the heating wire lines 120 having small diameters according to examples 1 and 2 of the present disclosure is equivalent to that of the conventional heating wire lines.

Therefore, it is determined that the heating wire structures for glass 100 according to examples 1 and 2 may reduce the cross-sectional area of the heating wire lines 120 to ⅓ that of the heating wire lines of the conventional heating wire structures for glass according to comparative examples 1 and 2 while having the same performance as the conventional heating wire structures for glass.

In summary, it may be understood that the heating wire structures for glass 100 according to examples 1 and 2 reduce overheating of the antenna 130 and inhibit short circuit of the antenna lines 140 while having the same performance as the conventional heating wire structures for glass according to comparative examples 1 and 2.

FIGS. 4A to 4D illustrate various forms of the present disclosure, i.e., illustrate ceramic layers 170 formed in various shapes, formed of a black enamel layer in accordance with first to fourth forms of the present disclosure.

Figure 4A:
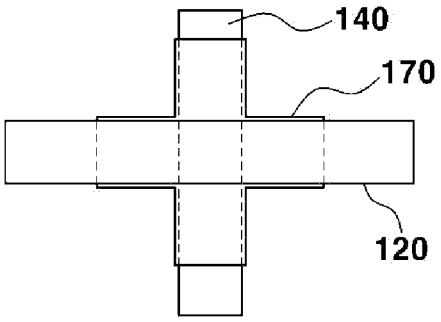
FIG. 4A is a view illustrating a shape of a ceramic layer located between a heating wire line and an antenna line in accordance with a first form of the present disclosure.

FIG. 4A illustrates a ceramic layer 170 in accordance with the first form, which extends along both the antenna line 140 and the heating wire line 120 at the intersection point 150 between the heating wire line 120 and the antenna line 140, and such a ceramic layer 170 has an optimal configuration to inhibit current from being applied between the heating wire line 120 and the antenna line 140. However, the range of the ceramic layer 170 in accordance with this form, exposed to the outside of the rear window glass 200, is somewhat larger than those of ceramic layers in accordance with other forms.

Figure 4B:
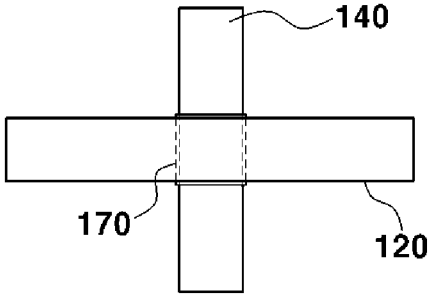
FIG. 4B is a view illustrating a shape of a ceramic layer located between a heating wire line and an antenna line in accordance with a second form of the present disclosure.

FIG. 4B illustrates a ceramic layer 170 in accordance with the second form, which is located only at the intersection point 150 between the heating wire line 120 and the antenna line 140, i.e., only at a position where the antenna line 140 and the heating wire line 120 are directly opposite to each other.

In the second form of the present disclosure, a surface of the ceramic layer 170 exposed to the outside of the rear window glass 200 may be reduced, but, in order to inhibit current from being applied between the antenna line 140 and the heating wire line 120, high precision in a working process may be desired.

Figure 4C:
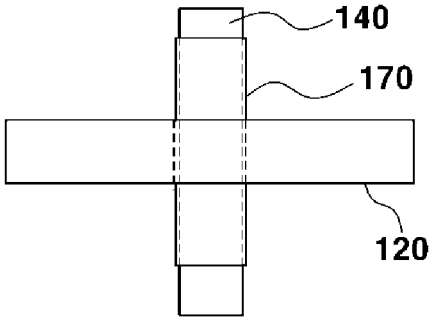
FIG. 4C is a view illustrating a shape of a ceramic layer located between a heating wire line and an antenna line in accordance with a third form of the present disclosure.
Figure 4D:
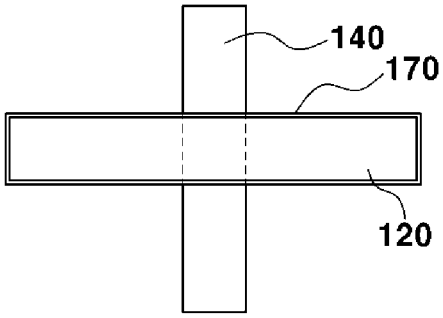
FIG. 4D is a view illustrating a shape of a ceramic layer located between a heating wire line and an antenna line in accordance with a fourth form of the present disclosure.

FIG. 4C illustrates a ceramic layer 170 in accordance with the third form, which extends along the antenna line 140, and FIG. 4D illustrates a ceramic layer 170 in accordance with the fourth form, which extends along the heating wire line 120.

As exemplarily shown in FIGS. 4A to 4D, the ceramic layer 170 in accordance with the present disclosure may perform a function of inhibiting current from being applied between the antenna line 140 and the heating wire line 120 while reducing an exposed surface of the ceramic layer 170, and various forms other than the above-descried forms may be provided.

As described above, the heating wire structure for glass inhibits overheating and short circuit of antenna lines overlapping heating wire lines, which are connected in series and used in a 42V~48V battery system, thus increasing durability of the heating wire lines and an antenna on a window glass in a vehicle.

Furthermore, the heating wire structure for glass includes a ceramic layer which may reduce a diameter and length of the heating wire lines at a high voltage, thus reducing manufacturing costs.

While this present disclosure has been described in connection with what is presently considered to be practical exemplary forms, it is to be understood that the present disclosure is not limited to the disclosed forms, but, on the contrary, it is intended to cover various modifications and equivalent arrangements included within the spirit and scope of the present disclosure.

What is claimed is:

1. A heating wire structure for glass of a vehicle having a battery located within the vehicle and configured to apply power according to a user request, the heating wire structure comprising:

a sheet of glass;

heating wires located in one direction on the glass and connected to terminals of the battery in series;

vertical bars located at both ends of the glass so that the heating wires are connected to the vertical bars;

antenna lines connected to an antenna, at least some of the antenna lines including intersection points formed by intersecting the heating wires; and a ceramic layer formed at intersecting areas where the heating wires and the antenna lines intersect each other, the ceramic layer configured to be located between the heating wires and the antenna lines, wherein the ceramic layer is configured to match in shape each intersecting area and to extend along at least one of the antenna lines or the heating wires by a predetermined range, and the ceramic layers formed at the intersecting areas are not connected to each other such that a surface of the ceramic layers exposed to an outside of the glass is reduced.

2. The heating wire structure for glass of claim 1, wherein the ceramic layer is formed of a material having the same properties as an enamel part.

3. The heating wire structure for glass of claim 1, wherein the battery provides a voltage of 42V-48V.

4. The heating wire structure for glass of claim 1, wherein the heating wires include a plurality of heating wire lines disposed in a horizontal direction of the glass.

5. The heating wire structure for glass of claim 1, wherein the at least some of the antenna lines are disposed in a vertical direction of the glass.

6. The heating wire structure for glass of claim 1, wherein the terminals connected to a cathode and an anode of the battery are located at upper and lower ends of one side part of the glass, respectively.

7. The heating wire structure for glass of claim 1, further comprising an enamel part formed to surround an edge of the glass.

* * * * *